United States Patent [19]

Ohe et al.

[11] Patent Number: 4,755,823

[45] Date of Patent: Jul. 5, 1988

[54] KEYLESS VEHICLE ENTRY APPARATUS

[75] Inventors: Junzo Ohe; Hiroshi Kondo, both of Toyota, Japan

[73] Assignee: Toyota Jidosha Kabushiki Kaisha, Toyota, Japan

[21] Appl. No.: 893,087

[22] Filed: Aug. 4, 1986

[30] Foreign Application Priority Data

Aug. 9, 1985 [JP] Japan ..... 60-175219
Aug. 9, 1985 [JP] Japan ..... 60-175220

[51] Int. Cl.[4] ..... H01Q 1/32
[52] U.S. Cl. ..... 343/713; 343/712
[58] Field of Search ..... 343/711, 712, 713

[56] References Cited

FOREIGN PATENT DOCUMENTS

| | | | |
|---|---|---|---|
| 0180462 | 5/1986 | European Pat. Off. . | |
| 0181120 | 5/1986 | European Pat. Off. . | |
| 0184447 | 6/1986 | European Pat. Off. . | |
| 53-34826 | 8/1978 | Japan . | |
| 60-172804 | 9/1985 | Japan | 343/713 |
| 2018482 | 10/1979 | United Kingdom . | |
| 2051442 | 1/1981 | United Kingdom . | |

OTHER PUBLICATIONS

Abstract of 55-88407 Antenna Device.
Abstract of 60-169204 On Vehicle Antenna System.
Abstract of 60-172804 Antenna System for Vehicle.

*Primary Examiner*—William L. Sikes
*Assistant Examiner*—Robert E. Wise
*Attorney, Agent, or Firm*—Cushman, Darby & Cushman

[57] ABSTRACT

A keyless entry apparatus for locking and unlocking a door, trunk lid, and window of a vehicle uses electric waves radiated from a transmitter which are received by a pickup which is provided on a vehicle body in a concealed state without any external exposure which would impair the aesthetic appearance of the vehicle body. The pickup consists of a loop antenna or an electrostatic detection antenna which detects the surface currents induced on the vehicle body by the electric waves radiated from the transmitter. The pickup is disposed at a portion on which the surface currents are concentrated such as, for example, a front pillar, trunk lid and roof.

10 Claims, 19 Drawing Sheets

(A)

(B)

KEYLESS VEHICLE ENTRY APPARATUS

BACKGROUND OF THE INVENTION

1. Field of the Invention

The present invention relates to a keyless vehicle entry apparatus and, more particularly, to a keyless vehicle entry apparatus for automatically locking and unlocking a door on receiving a code signal consisting of electric waves from a transmitter.

2. Description of the Prior Art

Keyless vehicle entry apparatus designed to automatically lock or unlock a door on receiving a code signal of very weak electric waves from a transmitter have recently come into general use, in particular, for high-quality cars wherein such an apparatus replaces a conventional door locking device in which a key is used.

It is possible to provide such a keyless vehicle entry apparatus not only on a door with locking and unlocking functions but also with various additional functions such as, for example, opening and closing a trunk or a window, or warning of a possible car-theft, thereby providing many advantages for the driver or owner of the vehicle.

In such a conventional keyless vehicle entry apparatus, as exemplified by that shown in FIG. 28, a code signal consisting of electric waves (of 60 MHz in the example shown in FIG. 28) delivered from a transmission antenna 12 of a transmitter 10 is received by a pole antenna 16 for radio broadcast wave reception which is provided on the surface of a vehicle body 14, and the receiving signal is input to a divider 20 through a feeder line 18. The divider 20 divides the receiving signal into the outputs of a radio 22 and a keyless entry signal receiver 24.

As a result, a sound signal is output from the speaker 26 of the radio 22 and a control signal 28 for locking or unlocking a door is output from the keyless entry signal receiver 24.

Such a conventional keyless vehicle entry apparatus, however, which divides a receiving signal of the antenna for radio broadcast wave reception into two, causes a drop in the receiving sensitivity for radio broadcast waves by about 3 dB. Furthermore, since the antenna for radio broadcast wave reception is adjusted mainly for radio broadcasting frequency bands, in particular, for the FM band (76 to 90 MHz in Japan), adequate sensitivity is sometimes unobtainable for the carrier frequency (60 MHz) of the electric waves which are generally used for propagating a code signal in a keyless vehicle entry apparatus.

In addition, in a strong electric field zone, such as the vicinity of a transmitting station for FM broadcasts or TV broadcasts, a strong input jamming occurs, and this necessitates such countermeasures as filtering and trapping.

Thus, it is necessary to provide an antenna exclusively for use by the keyless vehicle entry apparatus for automatically locking and unlocking a door on receiving a code signal consisting of electric waves from a transmitter. However, though a pole antenna which projects outwardly from the vehicle body is superior in performance in its own way, it always remains a nuisance from the point of view of vehicle design.

Furthermore, such a pole antenna is disadvantageous in that it is subject to damage, tampering or theft and also in that the antenna tends to generate noise during high-speed driving. For these reasons, there has heretofore been a strong desire to eliminate the need for such pole antennas, and to thus provide a second pole antenna would be at variance with this desire.

One of the proposals made to eliminate such problems has been to provide a receiving loop antenna for a keyless vehicle entry apparatus on a molding located in the vicinity of the outside handle of a door (Japanese Patent Laid-Open No. 44861/1984).

This keyless vehicle entry apparatus is advantageous in that the electric waves from a transmitter can be positively received without changing the external form or appearance of a vehicle body.

Such an improved keyless vehicle entry apparatus, however, is comparatively low in sensitivity, and, in addition, it is necessary from the viewpoint of its directional characteristics to dispose a transmitting antenna in close proximity to (at a distance of about 10 cm from) the receiving loop antenna.

Thus, it is inconveniently impossible to enjoy the full advantage of the keyless vehicle entry apparatus which can automatically lock and unlock a door when the operator is standing at a certain distance from the vehicle body.

SUMMARY OF THE INVENTION

Accordingly, it is an object of the present invention to provide a keyless vehicle entry apparatus having good operability which does not affect the aesthetic appearance of a vehicle body, thereby eliminating the above-described problems.

To achieve this aim, a keyless vehicle entry apparatus according to the present invention is so composed that the electric waves from a transmitter are received by a pickup for detecting the surface currents induced on the vehicle body by those electric waves.

As is clear from the above, a keyless vehicle entry apparatus according to the present invention with the aforementioned structure performs the electric wave receiving operation by means of a pickup for detecting the surface currents induced on the vehicle body. Since it is possible to build in the pickup within the vehicle body, it does not affect the aesthetic appearance of the vehicle body.

Thus, it is possible to provide a pickup exclusive for the keyless vehicle entry apparatus, and to completely exclude any jamming wave from broadcast stations, transmission lines or the like, by setting the receivable frequency in a narrow band.

It is also possible to provide a substantially non-directional keyless vehicle entry apparatus by providing two or more pickups on the vehicle body so that they compensate for each other with respect to directivity.

The above and other objects, features and advantages of the present invention will become clear from the following description of the preferred embodiments thereof, taken in conjunction with the accompanying drawings.

DESCRIPTION OF THE PREFERRED EMBODIMENTS

Preferred embodiments of the present invention will be explained hereinunder with reference to the accompanying drawings.

Location of a Pickup

FIGS. 29 to 34 illustrate a process for examining the distribution characteristics of high-frequency currents so as to ascertain the location at which a pickup can operate most efficiently on the vehicle body of an automobile.

Figure 29:
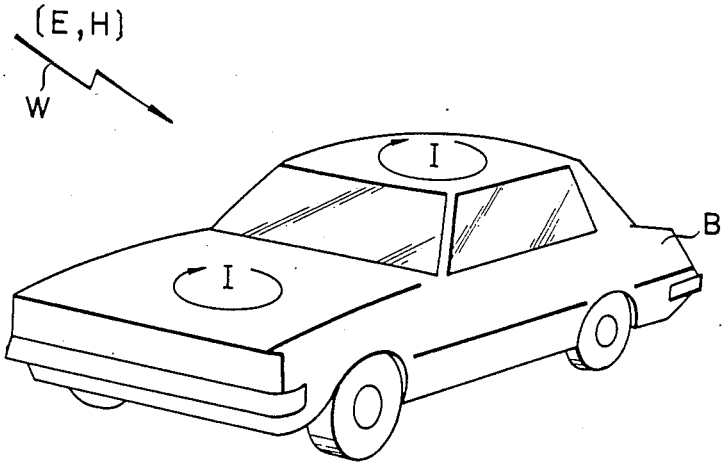
FIG. 29 illustrates surface currents I induced on the vehicle body B by the electric waves W from a transmitter.

FIG. 29 shows that when the electric waves W from a transmitter pass through the vehicle body B of conductive metal, surface currents I are induced at various vehicle locations at levels corresponding to the intensities of electromagnetic waves passing therethrough. The present invention aims at only electromagnetic waves of relatively high frequency bands of 60 MHz which are used for transmitting code signals in a keyless vehicle entry apparatus.

The present invention is characterized in that the distribution of the surface currents induced on the vehicle body by electromagnetic waves within the above-described particular wave bands is measured so as to seek a location on the vehicle body which is higher in surface current density and lower in noise and at which a pickup used in the present invention is located.

The distribution of surface currents is determined by a simulation using a computer and also by measuring actual intensities of surface currents at various locations on a vehicle body. In accordance with the present invention, the measurement is carried out by the use of a probe which can operate in accordance with the same principle as that of a high-frequency pickup actually located on the vehicle body at a desired location, as will be described later. Such a probe is moved on the vehicle body throughout the entire surface thereof to measure the level of surface currents at various locations of the vehicle body.

Figure 30:
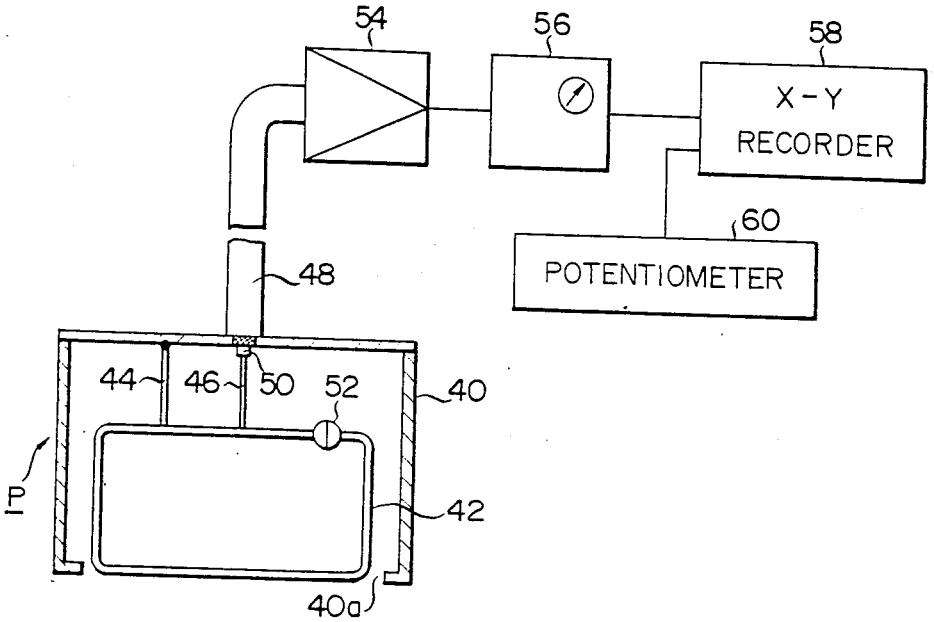
FIG. 30 illustrates a probe for detecting the distribution of surface currents on the vehicle body and having the same construction as that of the pickup used in the present invention, and a circuit for processing signals from the probe.

FIG. 30 shows an example of such a probe P which is constructed in accordance with substantially the same principle as that of the high-frequency pickup described hereinafter. The probe P is composed of a casing 40 of electrically conductive material for preventing any external electromagnetic wave from transmitting to the interior thereof and a loop coil 42 fixed within the casing 40. The casing 40 includes an opening 40*a* formed therein through which a portion of the loop coil 42 is externally exposed. The exposed portion of the loop coil 42 is located in close proximity to the surface of the vehicle body B to detect magnetic flux induced by surface currents on the vehicle body B.

Another portion of the loop coil 42 is connected with the casing 40 through a short-circuiting line 44. The loop coil 42 further includes an output end 46 connected with a core 50 in a coaxial cable 48. Still another portion of the loop coil 42 includes a capacitor 52 for causing the frequency in the loop coil 42 to resonate relative to the desired frequency to be measured (60 MHz, in FIG. 30) to increase the efficiency of the pickup.

Thus, when the probe P is moved along the surface of the vehicle body B and also angularly rotated at various locations of measurement, the distribution and direction of surface currents can accurately be determined at each of the vehicle locations. In FIG. 30, the output of the probe P is amplified by a high-frequency voltage amplifier 54 and the resulting output voltage is measured by a high-frequency voltmeter 56.

This coil output voltage is read at the indicated value of the high-frequency voltmeter 56 and also is recorded by an XY recorder 58 to provide the distribution of surface currents at various vehicle locations.

The input of the XY recorder 58 receives signals indicative of various vehicle locations from a potentiometer 60 to recognize the value of high-frequency pickup currents at the corresponding vehicle location.

Figure 31:
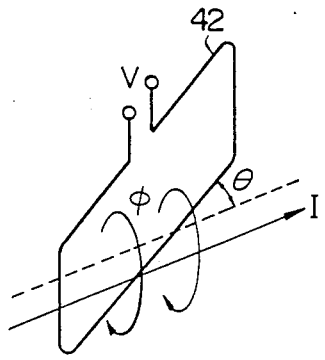
FIG. 31 illustrates the electromagnetic coupling between the surface currents I and the loop coil of the pickup.
Figure 32:
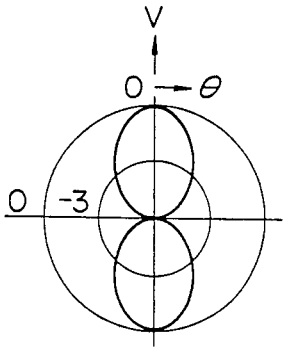
FIG. 32 illustrates the directional pattern of the loop antenna shown in FIG. 31.

FIG. 31 illustrates an angle $\theta$ of deflection between the high-frequency surface currents I and the loop coil 42 of the pickup. As is clear from the drawing, magnetic flux $\theta$ interlinks with the loop coil to generate a detection voltage V in the loop coil 42. As shown in FIG. 31, when the angle $\theta$ of deflection is equal to zero, that is, the surface currents I are parallel to the loop coil 32 of the pickup, the maximum voltage can be obtained. The direction of the surface currents I when the probe P is rotated to obtain the maximum voltage can also be known.

Figure 33:
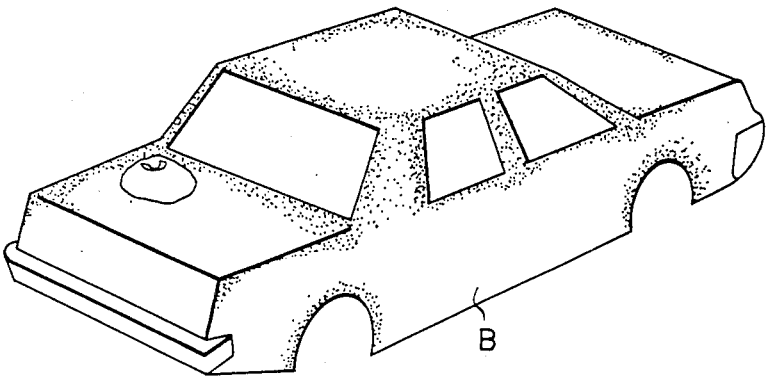
FIG. 33 illustrates the intensity distribution of the surface currents.
Figure 34:
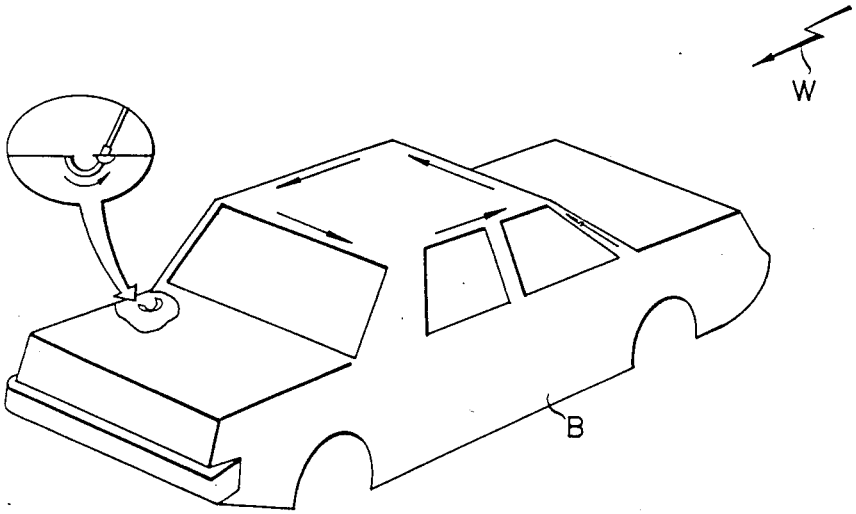
FIG. 34 illustrates the directions of flow of the surface currents.

FIGS. 33 and 34 respectively show the magnitude and direction of high-frequency surface currents induced at various different locations of the vehicle body at the frequency of 60 MHz, the values of which are obtained from the measurements of the probe P and the simulation effected by the computer. As is clear from FIG. 33, the distribution of surface currents has higher densities at the marginal edge of the vehicle body and lower densities at the central portion of the flat vehicle panels.

It will also be apparent from FIG. 34, that the surface currents are concentrated in the direction parallel to the marginal edge of the vehicle body or in the direction along the connections of various flat panels.

Additionally, the value of the current decreases in correspondence with the distance from the edge of the metal flat portion of the vehicle body. Since the range under 6 dB is the lower limit for currents in which good sensitivity is actually obtainable, very good sensitivity may be obtained if the pickup is disposed within a distance of 4.5cm from the peripheral edge.

The present invention has been made on the basis of the above-described findings, and a high-frequency pickup is disposed at a portion where surface currents flow concentratedly with high density.

First Embodiment

Figure 1:
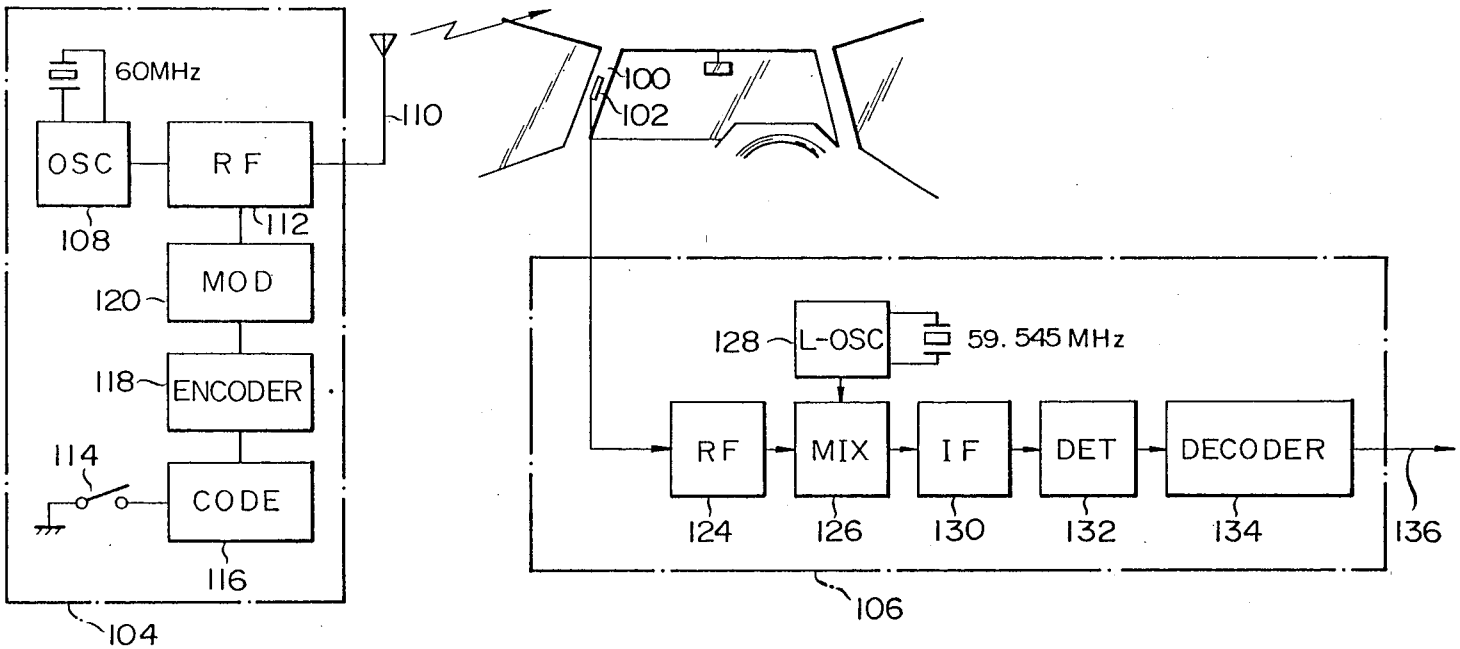
FIG. 1 is an explanatory view of a first embodiment of a keyless vehicle entry apparatus according to the present invention.

FIG. 1 shows a first embodiment of a keyless vehicle entry apparatus according to the present invention.

This embodiment is characterized in that a pickup 102 having a similar structure to the above-described probe is disposed at a front pillar 100 to detect the surface currents which flow concentratedly on the front pillar 100.

The center of the receiving bands for the pickup 102 is adjusted to be 60 MHz, and the pickup 102 is enabled to receive only high-frequency surface currents in a narrow band by impedance matching, so that the influence of jamming waves such as FM broadcast waves or TV broadcast waves is reduced.

A keyless vehicle entry apparatus in accordance with this embodiment includes a transmitter 104 which is operated by the user and a receiver 106 provided in the vehicle body, and when the pickup 102 detects the surface currents induced by the electric waves from the transmitter 104, the receiver 106 electrically processes them.

The transmitter 104 includes a crystal oscillator 108 which has a transmitting frequency of 60 MHz, and an RF amplifier 112 which RF amplifies the transmitting signal to supply it to a transmitting antenna 110, and the RF amplifier 112 is controlled by the keyless entry operation of the user.

The transmitter 104 includes a key operation switch 114 which is turned on or off by the user, and in accordance with the operation process or operation timing of the switch 114, a code setting circuit 116 receives an electrical input signal.

The output of the code setting circuit 116 is converted to a desired electrical signal by an encoder 118, and the coded signal controls the output of the RF amplifier 112 through a modulator 120.

Thus, according to the transmitter 104 shown in FIG. 1, a desired modulated keyless entry signal is transmitted from the transmitting antenna 110 by the keyless entry operation, namely, the operation of the switch 114 by the user.

On the vehicle body, high-frequency surface currents are induced by the electric waves from the transmitter 104, and the pickup 102 receives the above-described transmitted keyless entry signal from the surface currents, and supplies it to an RF amplifier 124 of the receiver 106 where it is subjected to a desired amplifying operation.

The amplified signal is mixed by a mixer 126 with a local oscillating frequency signal of, e.g., 59.545 MHz of a local oscillator 128, and is further amplified by an intermediate frequency amplifier 130.

The amplified signal is demodulated and detected by a detection circuit 132, and is decoded by a decoder 134 to the code set by the user.

The receiver 106 outputs the thus decoded keyless entry signal as a control signal 136 which is to be used for locking or unlocking a door, or for other purposes.

Figure 2:
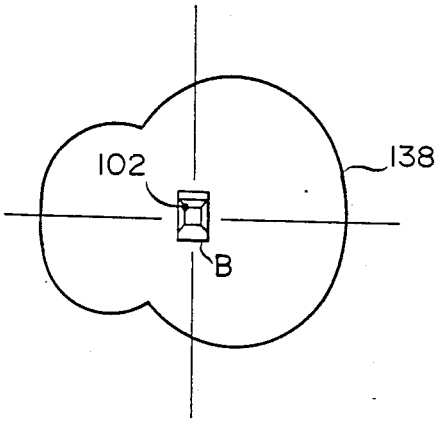
FIG. 2 illustrates the directional pattern of a pickup used for the first embodiment.

FIG. 2 shows the directional characteristic of the pickup in the 60 MHz frequency band which is provided on the left-hand front pillar of the vehicle body in the first embodiment. As is obvious from the characteristic curve 138, the pickup has good sensitivity on the right-hand side of the vehicle body, and slightly lowered sensitivity in the forward and backward directions of the vehicle body.

In other words, the keyless vehicle entry apparatus in accordance with this embodiment has good sensitivity on the driver's seat side where there is the greatest likelihood of the keyless entry operation being effected, thereby securing a good operability with respect to keyless entry operation.

The arrangement for attaching the pickup to the front pillar will now be explained in detail with reference to FIGS. 3 to 5.

Figure 3:
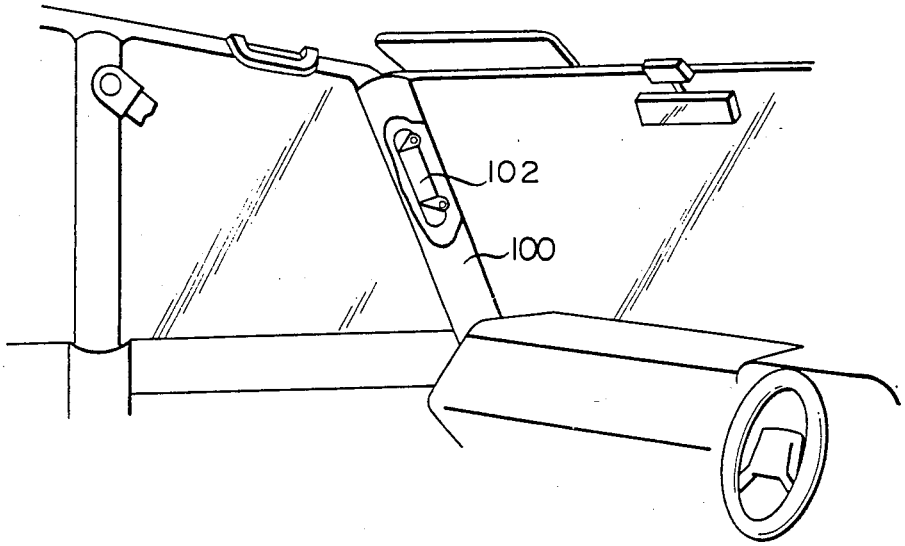

In FIG. 3 there is shown the schematic structure of the pickup in accordance with the present invention which is attached to the front pillar. The high-frequency pickup 102 is accommodated in the front pillar 100 for supporting the roof panel. In the embodiment, the high-frequency pickup 102 consists of an electromagnetic type pickup which includes a loop coil.

Figure 4:
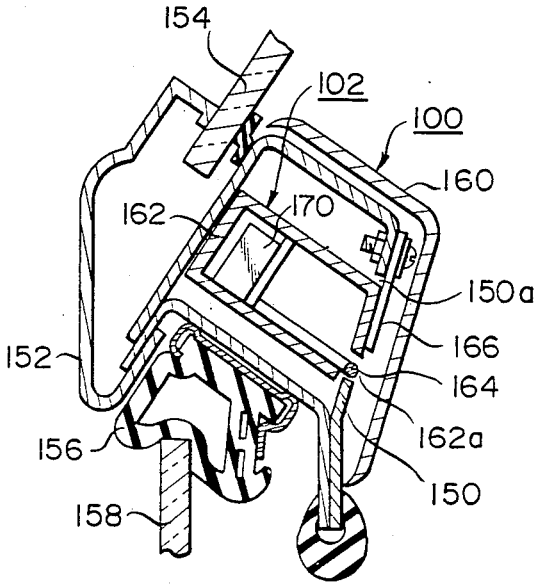

As is clear from the sectional view of FIG. 4, the pillar 100 includes a pedestal plate 150 which serves as the main pillar and has a configuration of a hollow prism. A windshield molding 152 is secured to the surface of the pedestal plate 150 which faces the exterior of the vehicle body, and the molding 152 retains a front windshield glass 154.

A weather strip rubber 156 is secured to the surface of the pedestal plate 150 which faces the rear portion of the vehicle body, thereby maintaining the water-sealed state of the joint between a side window glass 158 and the pedestal plate 150.

A front pillar garnish 160 is mounted on the surface of the pedestal plate 150 which faces the interior of the vehicle body to enclose the surface of the pedestal plate 150, thereby maintaining the aesthetically pleasing appearance of the vehicle body.

This embodiment is characterized in that a high frequency pickup is longitudinally disposed on the front pillar 100, and in the example shown in FIG. 4, the high-frequency pickup 102 of electromagnetic coupling type is inserted into the hollow portion of the pedestal plate 150.

Figure 5:
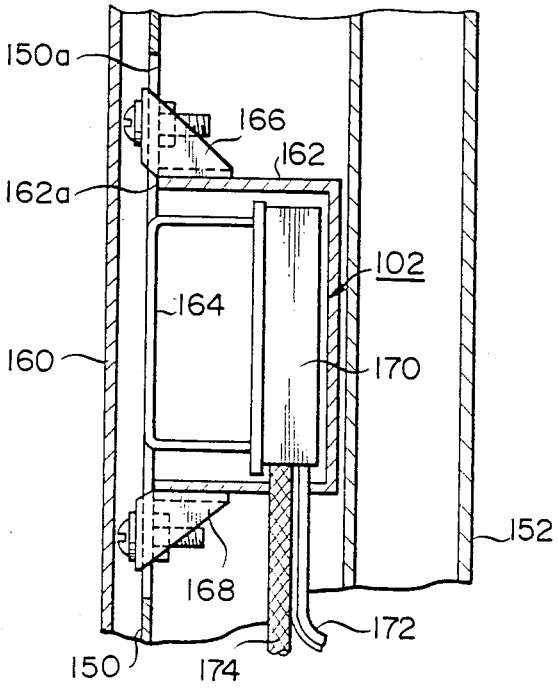
FIGS. 3 to 5 are explanatory views of the arrangement for attaching the pickup used for the first embodiment to a vehicle body.

The high-frequency pickup 102 is composed of a casing 162 of a conductive material and a loop coil 164 which is provided within the casing 162 and constitutes an antenna element, as is obvious from FIGS. 4 and 5. The casing 162 for shielding the loop coil from external magnetic flux is provided with an opening 162*a* at one side thereof. The loop coil 164 is exposed from the opening 162*a* and is disposed in proximity to the pillar where high-frequency surface currents flow concentratedly, in particular, to the pedestal plate 150.

In order to insert the high-frequency pickup 102 into the hollow prism of the pillar pedestal 150, an opening 150*a* is provided on a part of the pillar pedestal 150. The high-frequency pickup 102 is inserted into the pillar before the front garnish 160 is fixed.

In order to secure the casing 162 of the high-frequency pickup 102 to the pedestal plate 150, brackets 166, 168 are fixed to both sides of the casing 162 by spot welding or the like, and the brackets 166, 168 are tightly screwed to the pedestal plate 150.

Accordingly, the loop coil 164 in this fixed state is disposed in the vicinity of the opening portion 150*a* of the pedestal plate 150, whereby the magnetic flux induced by the surface currents which flow concentratedly on the pedestal plate 150 are effectively interlinked with the loop coil 164.

A circuitry 170 including a pre-amplifier and the like is housed behind the loop coil 164 in the casing 162. A power source and a signal for controlling the circuit is supplied from a cable 172 to the circuitry 170, and the high-frequency detection signal detected by the loop coil 164 is fetched outward from a coaxial cable 174 and is processed by a circuit similar to that used for examining distribution of surface currents.

The loop coil 164 is in the form of a single wound coil which is covered with an insulation such that the coil can be arranged in an electrically insulated relationship with and in close contact with the pedestal plate 150. Preferably the loop coil 164 is attached to the peripheral edge of the pedestal plate 204. Thus, the magnetic flux induced by the surface currents concentratedly flowing on the pedestal plate 150 are allowed to be interlinked with the loop coil 164 with good efficiency.

After the high frequency pickup 102*a* is inserted into the front pillar 100 in this way, the front pillar 100 is covered with the front pillar garnish 160. Thus, the structure of the front pillar 100 is perfectly the same as an ordinary pillar in terms of external appearance.

As a result, the high-frequency surface currents which are concentrated and flow on the front pillar are detected with good efficiency by the loop coil which is longitudinally provided there, thereby ensuring reception in the high-frequency bands without any external exposure of the antenna system.

Although an electromagnetic coupling type pickup is used as the high-frequency pickup in this embodiment, since the keyless entry apparatus according to the present invention is characterized by detection of the surface currents on the pillars for reception of the electric waves from the transmitter, an electrostatic coupling type pickup is also usable as the high frequency pickup as well as the electromagnetic type pickup.

When an electrostatic coupling type pickup is used, a detection electrode is longitudinally disposed on the pillar in FIGS. 3 and 4 through an air layer or an insulation layer, and a high-frequency signal is fetched to the detection electrode side through the electrostatic capacity formed between the surface of the pillar and the detection electrode, thereby making it possible to fetch a high-frequency signal in the carrier frequency of 60 MHz which is used for propagation of the signal in an ordinary keyless entry apparatus.

Second Embodiment

A second embodiment of a keyless vehicle entry apparatus according to the present invention will be explained, in which a pickup is longitudinally disposed at the peripheral edge of the engine hood.

In this embodiment, the pickup is disposed on the rear peripheral end portion of the engine hood and its directional characteristic has high sensitivity in the forward direction of the vehicle body.

The arrangement for attaching the pickup to the engine hood will be explained in detail with reference to FIGS. 6 to 8.

Figure 6:
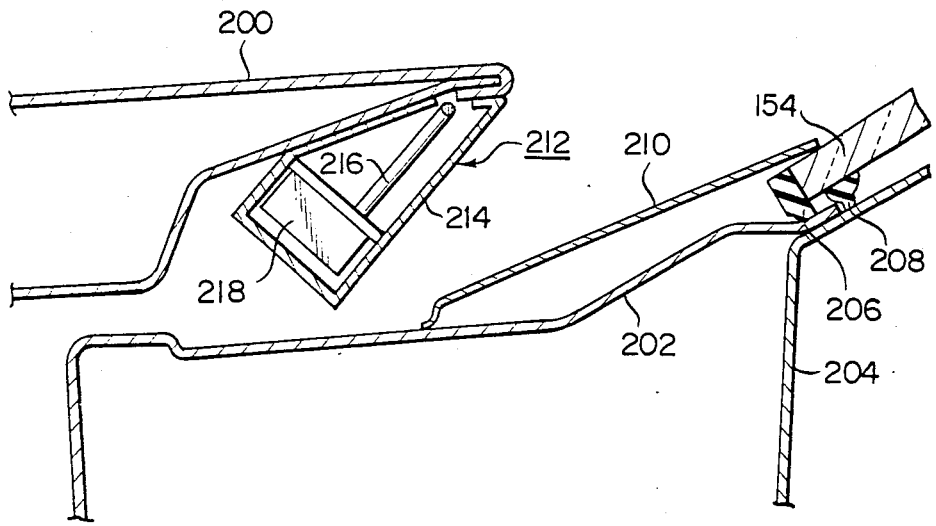
FIGS. 6 to 8 are explanatory views of the arrangement for attaching the pickup used for a second embodiment of a keyless vehicle entry apparatus to a vehicle body.

In FIG. 6, an engine hood 264 is rotatably supported by the vehicle body at one end thereof, and in its closed state, the inner surface of the peripheral end portion which faces the front windshield glass 154 is opposed to a front outer panel 202. The inside of the front outer panel 202 is connected to a front inner panel 204 and the front windshield glass 154 is supported on the front outer panel 202 by a stopper 206. A dam 208 is provided between the front windshield glass 154 and the front inner panel 204, thereby preventing the ingress of rainwater or the like.

At the lower end of the front windshield glass 154, as is known, a molding 210 is provided.

A pickup 212 in this embodiment has a similar structure to the high-frequency pickup used in the first embodiment, and includes a casing 214, loop coil 216 and a circuitry 218.

This embodiment is characterized in that the pickup 212 is fixed within a distance of 6.0 cm from the peripheral portion, in particular, the peripheral edge of the engine hood which faces the front outer panel 201, whereby it is possible to positively detect the high-frequency surface currents which flow concentratedly with high density on peripheral portion of the engine hood.

Figure 7:
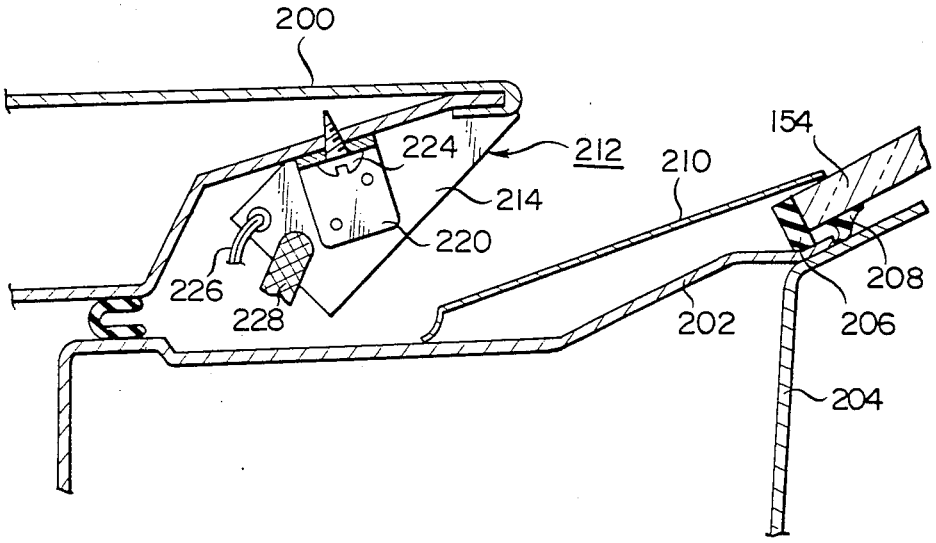
Figure 8:
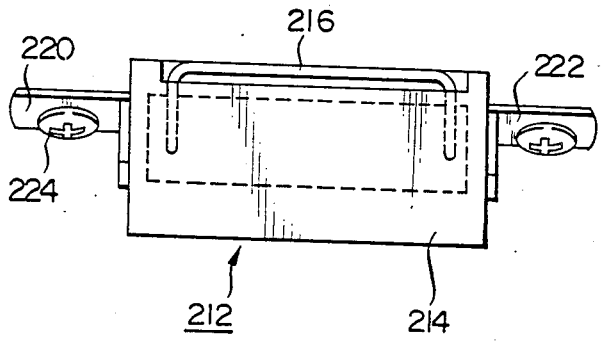

FIG. 7 shows the structure of the pickup 212 in this embodiment which is attached to the engine hood 200, and FIG. 8 is an external view of the high frequency pickup to be attached to the engine hood. The detail is approximately the same as that in the first embodiment. The pickup 212 is attached to the engine hood 200 by brackets 220 and 222, and a screw 224. A power source and a signal for controlling the circuitry are supplied from a cable 226, and a high-frequency detection signal is fetched by a coaxial cable 228.

It is necessary to select the locations of the pickup so as not to obstruct the accommodation of the wiper blades.

The structures of the transmitter and the receiver in this embodiment are the same as those in the first embodiment, and explanation thereof will therefore be omitted.

Third Embodiment

A third embodiment of a keyless vehicle entry apparatus according to the present invention will be explained, in which a pickup is disposed at the peripheral portion of the trunk lid.

In this embodiment, the pickup exhibits highly sensitive directivity in the backward direction of the vehicle body.

The arrangement of the pickup to the trunk lid will be explained in detail with reference to FIGS. 9 to 11.

Figure 9:
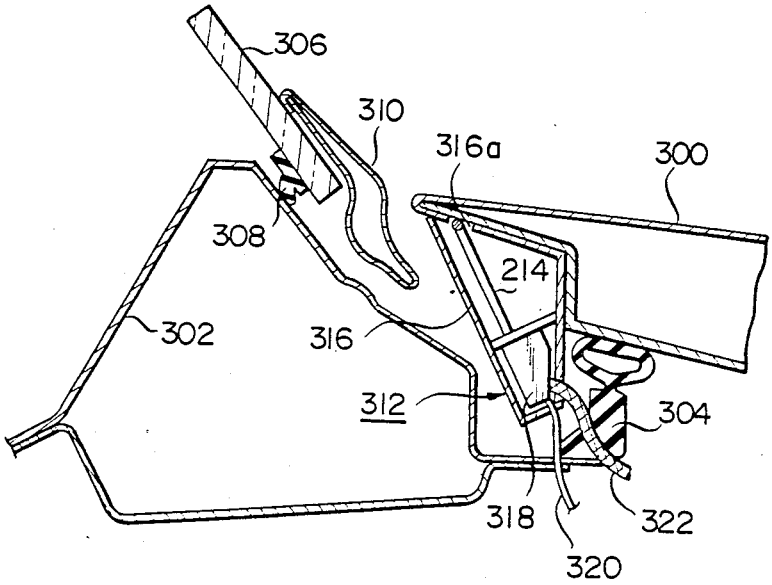
FIGS. 9 to 11 are explanatory views of the arrangement for attaching the pickup used for a third embodiment of a keyless vehicle entry apparatus to a vehicle body.

In FIG. 9, a water sealing weather strip 304 is provided between a trunk lid 300 and a rear tray panel 302 so as to prevent the ingress of rainwater or the like from a rear window glass 306.

A dam 308 provided between the rear window glass 306 and the rear tray panel 302 maintains airtightness and prevents the ingress of rainwater, sound or the like. A molding 310 is provided at the lower end of the rear window glass 306 on the external side, as is known.

In this embodiment, the pickup 312 is fixed at the peripheral end portion of the trunk lid 278 which faces the rear tray panel 302, and the pickup 312 consists of an electromagnetic coupling type pickup having a similar structure to that used in the first embodiment.

As is clear from FIG. 9, the loop coil 314 provided in the pickup 312 is disposed such that the longitudinal direction thereof agrees with the longitudinal direction of the trunk lid 300.

The loop coil 314 is disposed within a distance of 6.0 cm from the peripheral edge of the trunk lid 300, so that the loop coil 314 catch securely and with high efficiency the surface currents which flow concentratedly on the peripheral portion of the trunk lid 300.

Since surface currents flow on vehicle body along the marginal edge portions thereof, as is obvious from FIG. 34, the loop coil 314 in this embodiment is longitudinally disposed on the peripheral portion of the trunk lid 300.

The high-frequency pickup in this embodiment , as is the case with the first embodiment, includes a casing 316 of a conductive material. The casing 316 accommodates a loop coil 314 and circuitry 318, and has an opening 316*a* which is opposed to the trunk lid 300.

Thus, the magnetic flux alone which is induced by the high-frequency surface currents flowing on the peripheral portion of the trunk lid 300 is introduced into the casing 316, which can safely shield the loop coil 314 from external magnetic flux.

A power source and a signal are supplied to the circuitry 318 from a cable 320, and a high-frequency detection signal is fetched outwardly from a coaxial cable 322, and is processed by a circuit similar to that explained in the first embodiment.

In this way, according to this embodiment, since high-frequency surface currents are detected by means of the high-frequency pickup from the inside of the trunk lid, reception of a keyless entry signal is enabled without any external exposure of the antenna system.

Figure 10:
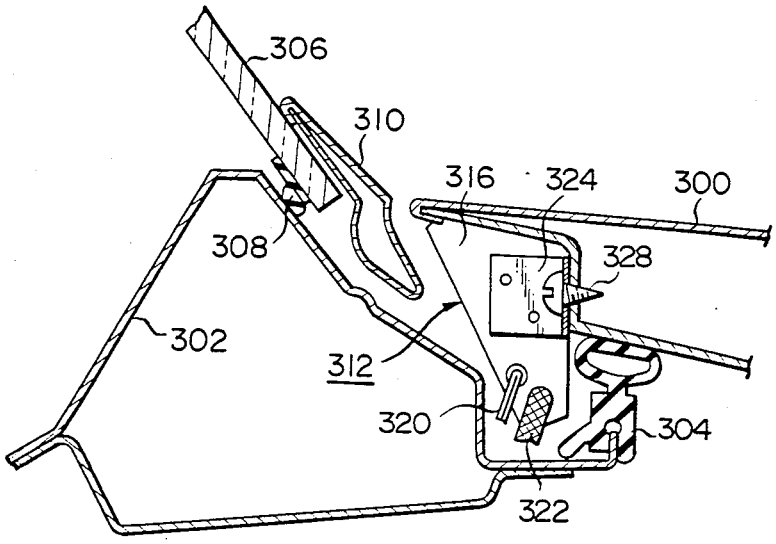

FIG. 10 shows the arrangement of the pickup 312 in accordance with this embodiment to the trunk lid 300. The same numerals are provided for those elements which are the same as those shown in FIG. 9, and explanation thereof will be omitted.

Brackets 324 and 326 are attached to the side surfaces of the casing 316 of the pickup 312 by bolts or the like, and the brackets 324 and 326 are secured to the inner panel of the trunk lid 300 by screws 328, thereby rigidly securing the high-frequency pickup 312 to the inside of the trunk lid 300.

Figure 11:
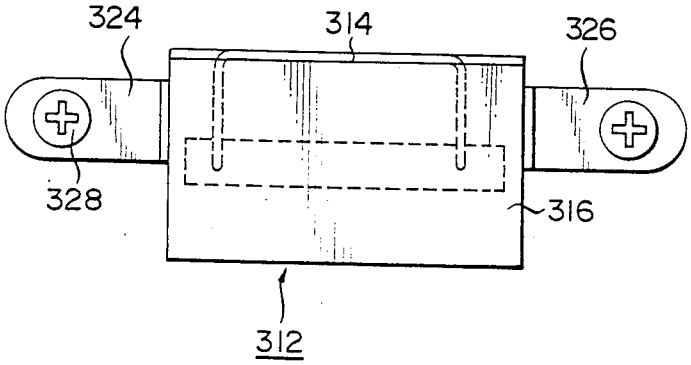
Figure 12:
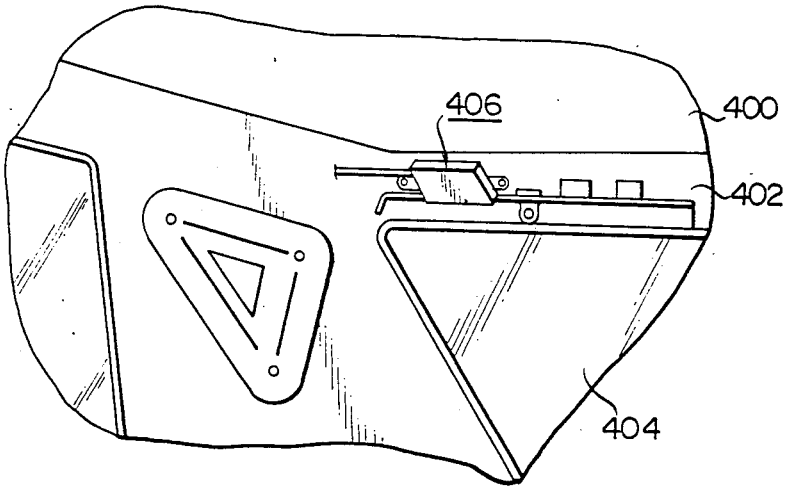
FIGS. 12 to 15 are explanatory views of the arrangement for attaching the pickup used for a fourth embodiment of a keyless vehicle entry apparatus to a vehicle body.
Figure 13:
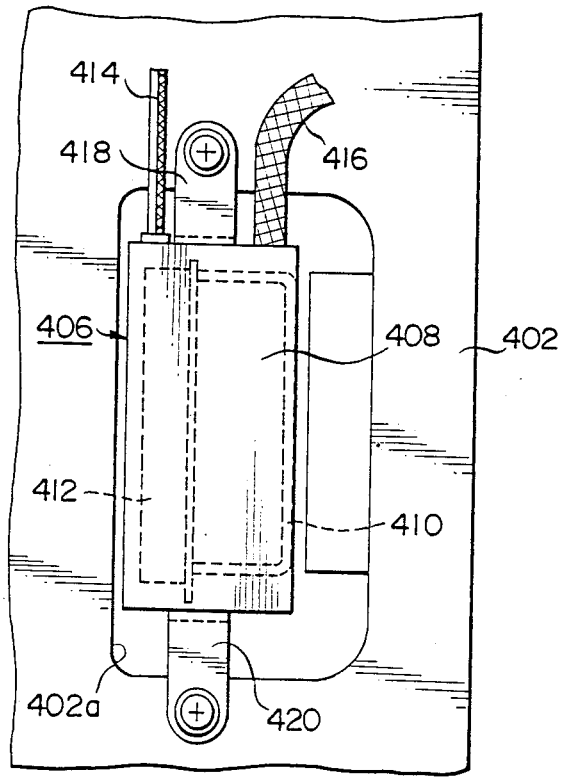

Therefore, the high-frequency pickup 312 is preferably constructed as shown in FIG. 11.

Fourth Embodiment

A fourth embodiment of a keyless vehicle entry apparatus according to the present invention will be explained, in which a pickup is provided in the vicinity of the rear roof of a vehicle body.

If the pickup in the keyless vehicle entry apparatus in accordance with this embodiment is disposed at the rear right-hand corner of the roof, the keyless vehicle entry apparatus exhibits good receiving sensitivity on the right-hand side of the vehicle body, namely, on the driver's seat side where it is most likely that the keyless entry operation will be effected. Thus it is to be understood that the above-described position is a preferred location.

The arrangement for attaching the pickup to the rear roof will be explained in detail hereinunder with reference to FIGS. 12 to 15.

A metal roof panel 400 which is illustrated in the exposed state is connected to a rear glass window 404 with a rear window frame 402 as its marginal end.

This embodiment is characterized in that a high-frequency pickup 406 is provided within a distance of 6.0 cm from the edge of the rear window frame 402.

As in the first embodiment, the pickup 406 includes a casing 408, a loop coil 410, circuitry 412, a cable 414, a coaxial cable 416 and brackets 418 and 420.

Figure 14:
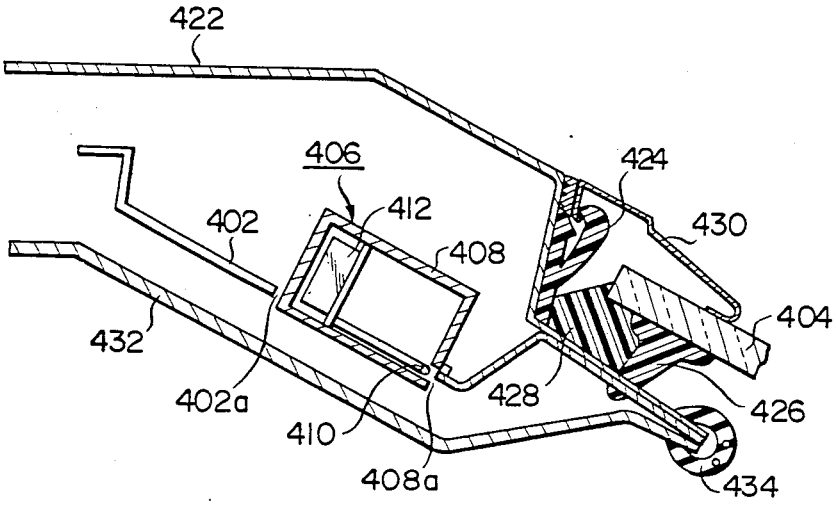
Figure 15:
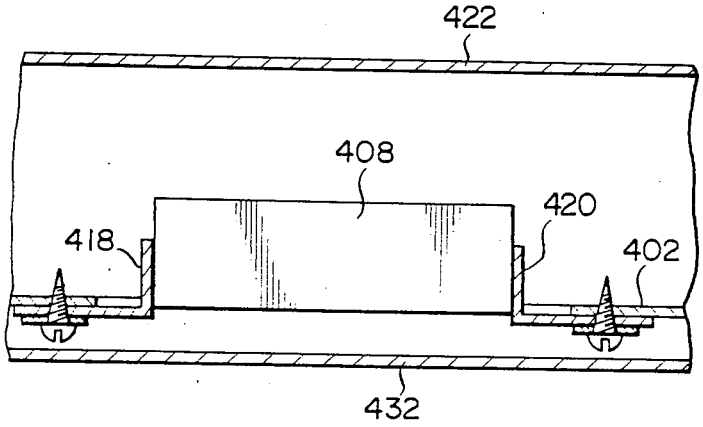

FIG. 14 is a cross sectional view of the pickup 406 which is fixed to the roof panel. The roof panel includes a roof panel 422, to one end of which the rear window frame 402 is secured. The rear window glass 404 is secured to the roof panel 422 through a fastener 424 and a dam 426, these two being rigidly bonded by an adhesive 428. A molding 430 is fixed between the roof panel 422 and the rear window glass 404.

An opening 402*a* for receiving the casing 408 of the pickup 406 is provided on a part of the rear window frame 402 in order that the loop coil 410 of the pickup 406 is opposed to the peripheral portion of the rear window frame 402.

The casing 408 is provided with an opening 408*a* such that a longitudinal side of the loop coil 410 is exposed therefrom. In this manner, a part of the loop coil 410 exposed from the casing 408 of a conductive material is opposed in proximity to the peripheral portion of the rear window frame 402.

After the pickup 406 is secured to the exposed roof panel, in particular, to the rear window frame 402 in this manner, a roof garnish 432 is secured to the roof panel, and an edge molding 434 is fixed at the end portions of the roof garnish 432 and the rear window frame 402.

A keyless entry signal output from the pickup provided in the above-described way is processed in a circuit similar to that in the first embodiment.

Fifth Embodiment

In a fifth embodiment of a keyless vehicle entry apparatus according to the present invention, a pickup is disposed on the front roof of a vehicle body.

If the pickup in the keyless vehicle entry apparatus in accordance with this embodiment is disposed at the front right-hand corner of the roof, the keyless vehicle entry apparatus exhibits good receiving sensitivity on the right-hand side of the vehicle body, namely, on the driver's seat side where it is most likely that the keyless entry operation will be effected. Thus it is to be understood that the above-described position is a preferred location.

Figure 16:
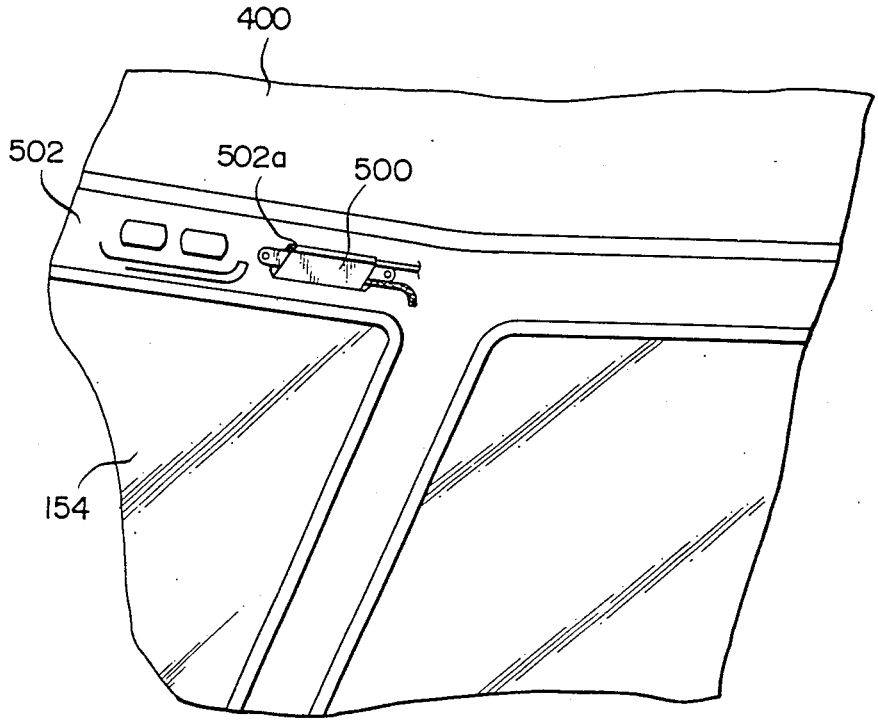
FIGS. 16 to 17 are explanatory views of the arrangement for attaching the pickup used for a fifth embodiment of a keyless vehicle entry apparatus to a vehicle body.

The detail of the arrangement for attaching the pickup to the front roof will be described in the following with respect to FIGS. 16 and 17.

The pickup 500 in this embodiment is disposed in a service hole 502*a* of the header inner panel 502.

Figure 17:
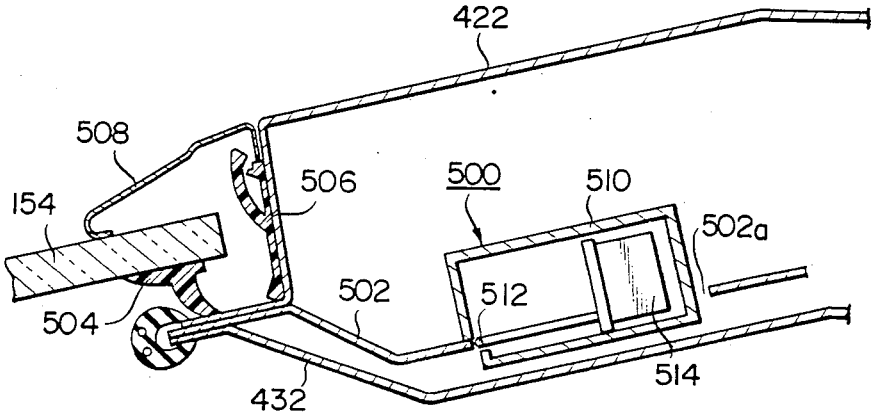

As is clear from FIG. 17, a front windshield glass 154 is secured to the roof panel 422 through a dam 504, and a molding 508 is fixed between the roof panel 422 and the front windshield glass 154 through a stopper 506, as is known.

The pickup 500 in this embodiment has a similar structure to that in the first embodiment, and includes a casing 510, loop coil 512 and a circuitry 514.

The loop coil 512 of the pickup 500 is secured within a distance of 6.0 cm from the peripheral edge of the header inner panel 502, thereby positively detecting the surface currents which are concentrated with high density on the header inner panel 502.

Sixth Embodiment

Figure 18:
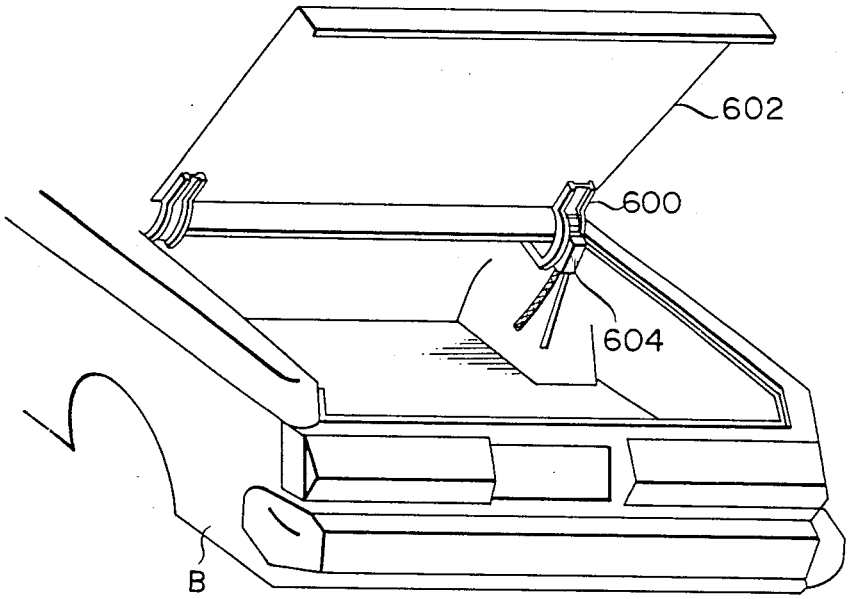
FIGS. 18 to 20 are explanatory views of the arrangement for attaching the pickup used for a sixth embodiment of a keyless vehicle entry apparatus to a vehicle body.
Figure 19:
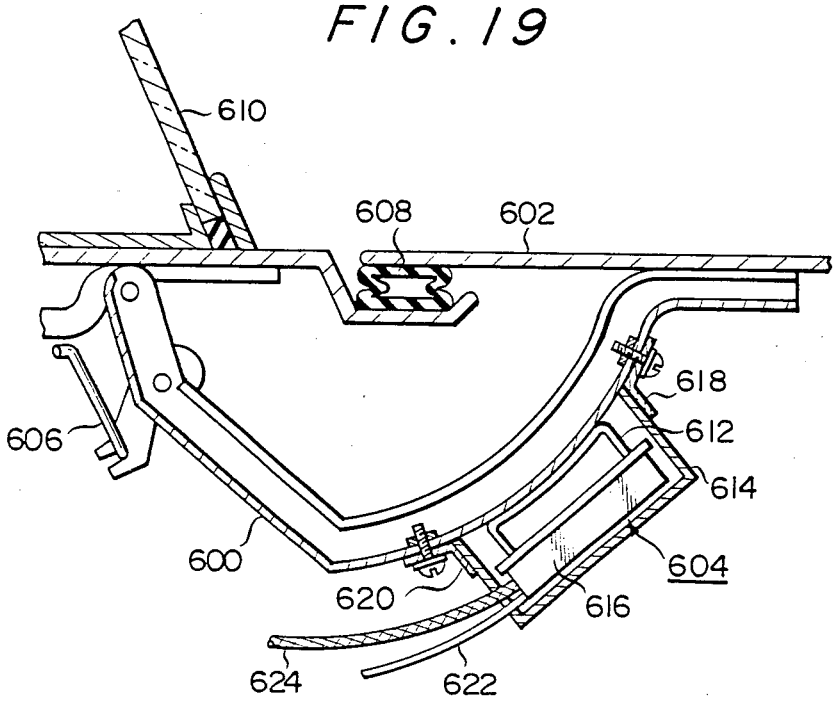
Figure 20:
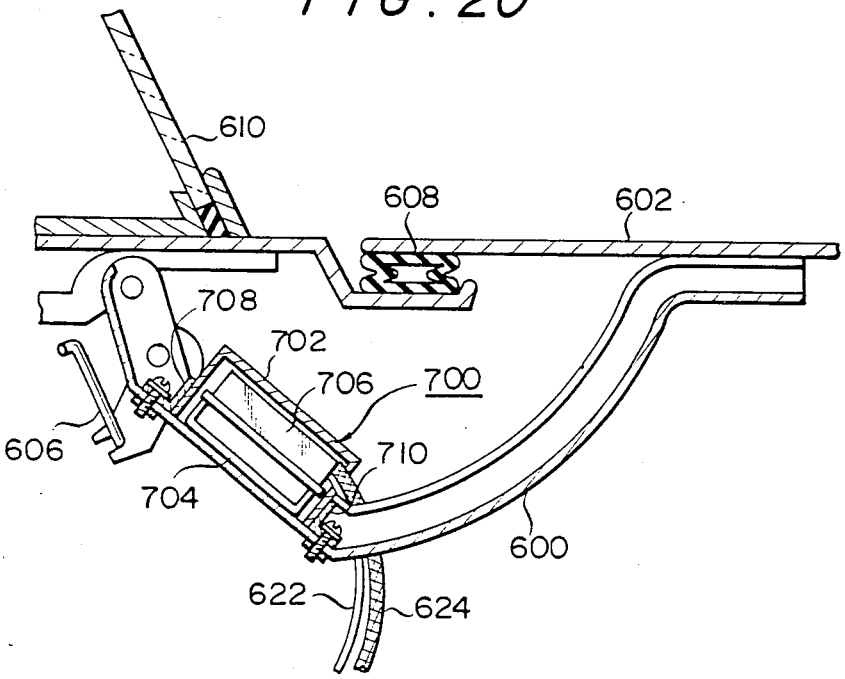

Referring next to FIGS. 18 to 20, which shows a sixth embodiment of the present invention, a pickup is attached to the trunk lid.

In FIG. 18, a trunk hinge 600 with one end thereof rotatably supported by the vehicle body and the other end secured to the trunk lid 602 rotatably supports the trunk lid 602.

This embodiment is characterized in that a pickup 604 is disposed on the trunk hinge 600.

A torsion bar 606 is provided on the end of the trunk hinge 600 which is rotatably supported by the vehicle body, so as to control the opening degree of the trunk lid 602 when it is open.

As is known, a water sealing weather strip rubber 608 is provided between the trunk lid 602 and the vehicle body, thereby preventing the ingress of rainwater from a rear window glass 610.

In this embodiment, the pickup 604 is longitudinally fixed on the outer surface of the trunk hinge 600, namely, on the side facing the trunk void, in such a manner that the longitudinal side of a loop coil 612 provided within the pickup 604 is disposed in parallel to the longitudinal side of the trunk hinge 600. In this way, the loop coil 612 can positively detect the surface currents flowing on the trunk hinge 600 with high efficiency.

The pickup 604 includes casing 614 and circuitry 616, as is the case with the first embodiment, and the opening side of the casing 614 is opposed to the trunk hinge 600.

Brackets 618 and 620 are secured to both open end portions of the casing 614, and one end of each of the brackets 618 and 620 is firmly screwed to the trunk hinge 600.

Therefore, it will be understood that the magnetic flux alone which is induced by the high-frequency surface currents flowing on the trunk hinge 600 is introduced into the casing 614, and the pickup is safely shielded from external magnetic flux by the casing 614.

The loop coil 612 is preferably provided along the trunk hinge 600 and is formed in conformity with the curvature of the trunk hinge 600.

Power source and a signal for controlling the circuit are supplied to the circuitry 616 from a cable 622, as described above, and the high-frequency detection signal fetched by the loop coil 612 is fetched outward by a coaxial cable 624, and is processed by a similar circuit to that in the first embodiment.

As described above, according to this embodiment, surface currents are detected from the trunk hinge which are unrelated to the detection of the surface currents in the prior art. In this manner, secure reception of the electric waves from the transmitter is enabled without any external exposure of the antenna of the keyless vehicle entry apparatus.

FIG. 20 shows another example of arrangement for attaching a pickup to the trunk hinge. The same numerals are provided for those elements which are the same as those in FIG. 19, and explanation thereof will be omitted.

In this example, a pickup 700 is attached to the back of the trunk hinge 600. A casing 702 accommodates a loop coil 704 and circuitry 706, and is firmly secured to the back of the trunk hinge 600 by brackets 708 and 710.

In this example, the pickup 700 does not protrude from the trunk hinge 600 into the trunk void, whereby it is prevented from coming into contact with the baggage or the like placed within the trunk void.

Seventh Embodiment

Figure 21:
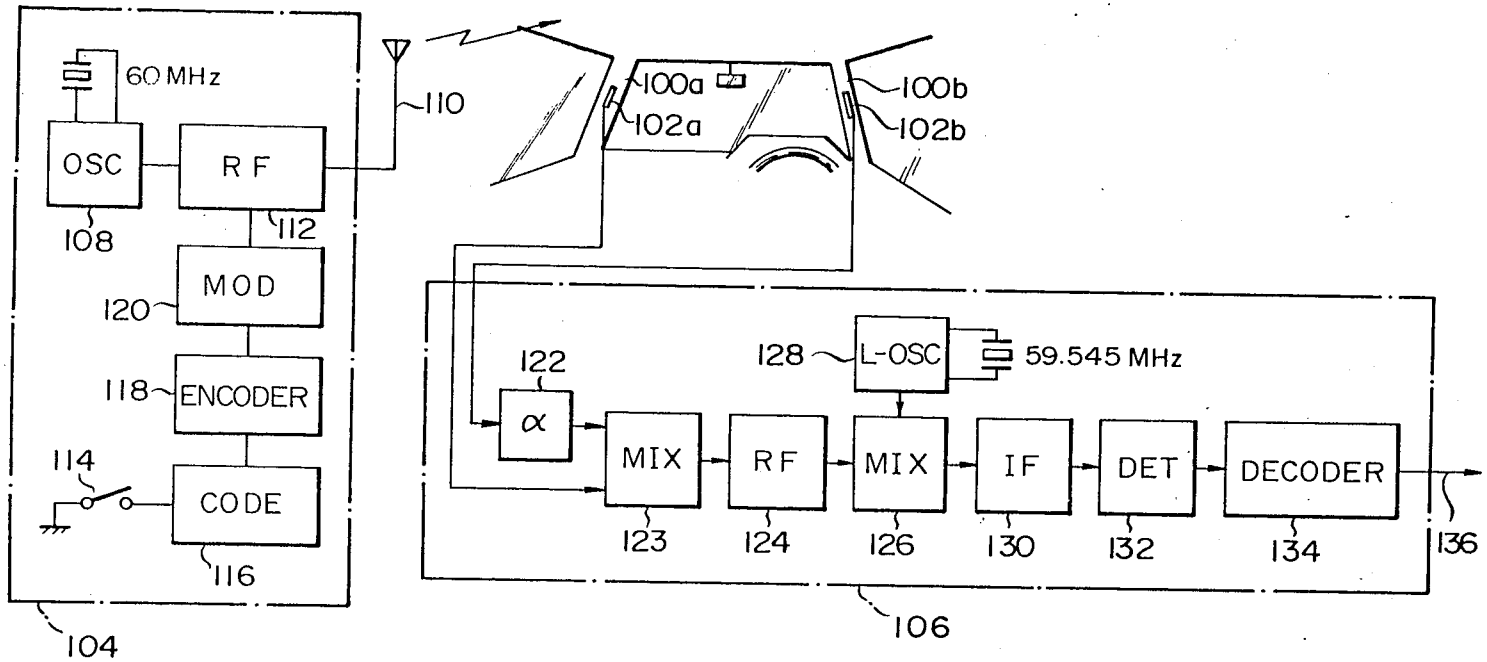
FIG. 21 is an explanatory view of a seventh embodiment of a keyless vehicle entry apparatus according to the present invention.

FIG. 21 shows a seventh embodiment of a keyless vehicle entry apparatus according to the present invention.

This embodiment is characterized in that pickups 102*a* and 102*b* which have a similar structure to the above-described probe are provided on front pillars 100*a* and 100*b*, respectively, on both sides of the vehicle body to detect the surface currents which flow concentratedly on the front pillars.

Thus, according to the seventh embodiment, the two pickups which are disposed on the respective sides of the vehicle body compensate for each other, thereby enjoying good receiving sensitivity.

In FIG. 21, the same numerals are provided for those elements which are the same as those in the first embodiment, and explanation thereof will be omitted.

High-frequency surface currents are induced on the vehicle body by the electric waves from the transmitter 104, the pickups 102*a* and 102*b* receive a keyless entry signal transmitted from the surface currents. The receiving signal of the pickup 102*a* is input, as it is, into a mixer 123, while the receiving signal of the pickup 102*b* is input into the mixer 123 after the phase thereof is corrected by a phase difference correction circuit 122. The receiving signals are mixed by the mixer 123, and thereafter the mixed signal is supplied into the RF amplifier 124 where it is subjected to a desired amplifying operation.

Figure 22:
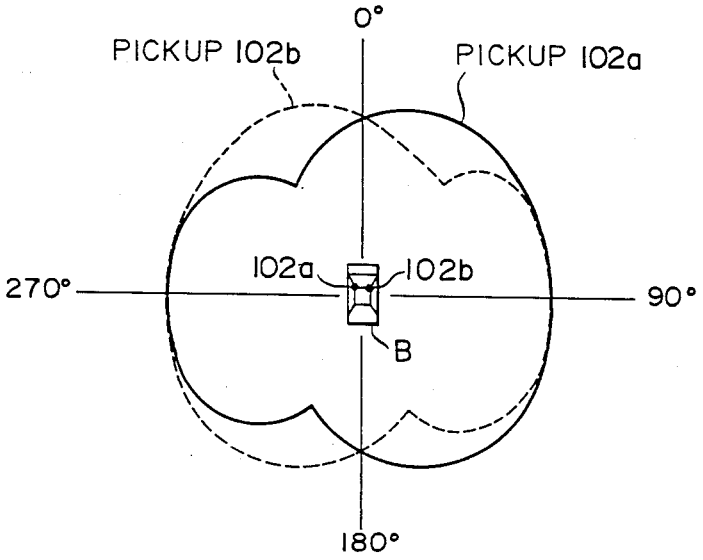
FIGS. 22*a* and 22*b* illustrate the directional patterns of the pickups used for the seventh embodiment.
Figure 22:
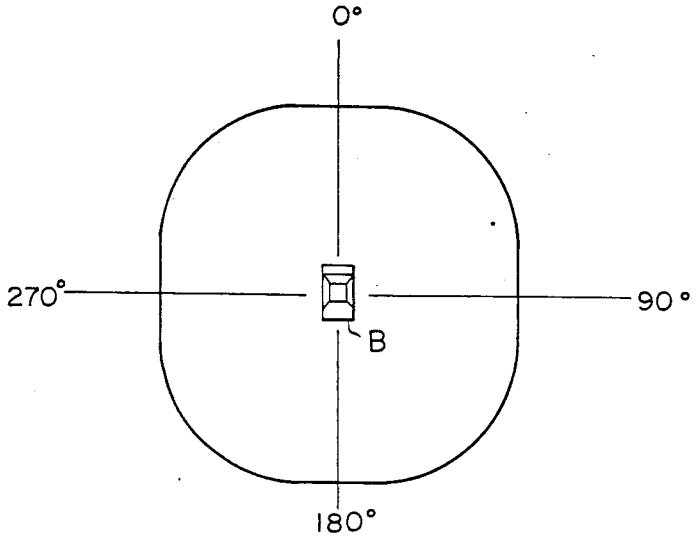

FIG. 22 shows the directional patterns of the antenna in the keyless vehicle entry apparatus in accordance with this embodiment in the frequency band of 60 MHz. In FIG. 22(A), the solid line shows the directional pattern of the pickup 102*a* and the broken line that of the pickup 102*b*, and FIG. 22(B) shows the characteristic curve of both pickups as a result of synthesizing the directivities thereof.

As is clear from FIG. 22(A), the pickup 102*a* exhibits good sensitivity on the right-hand side of the vehicle body, and slightly lowered sensitivity in the forward and backward directions of the vehicle body.

In contrast, the pickup 102b has a directivity completely contrary to that of the pickup 102a, and it is to be understood that both pickups compensate for each other with respect to sensitivity.

Accordingly, synthesis of the directional characteristics of both pickups 102 produces an approximately non-directional antenna, thereby enabling a good keyless entry operation from both sides of the vehicle body.

Other Embodiments

Figure 23:
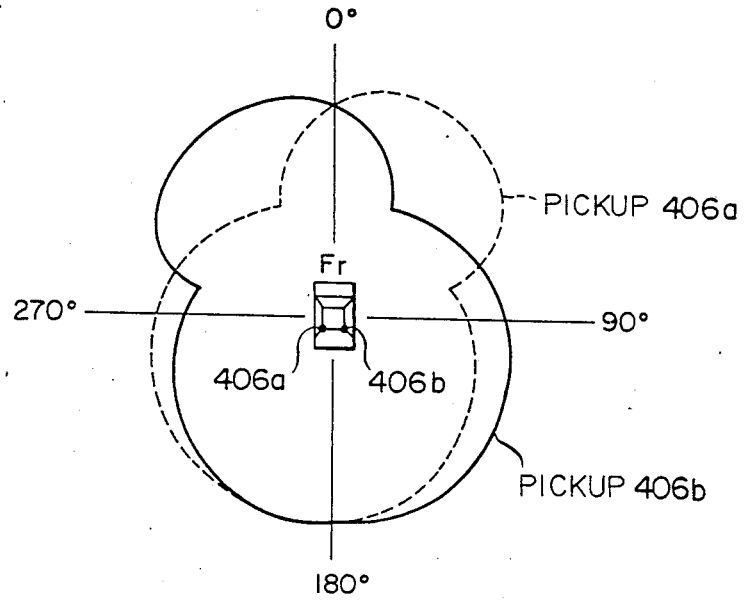
FIG. 23 illustrates the directional patterns of the pickups used for another embodiment of a keyless vehicle entry apparatus.

FIG. 23 shows the directional patterns of the antenna in another embodiment of a keyless vehicle entry apparatus according to the present invention.

This embodiment is characterized in that pickups are disposed on both rear corners of the roof of a vehicle body.

As is clear from FIG. 23, both pickups 406a and 406b in this embodiment also compensate for each other's lowered sensitivity, and improve the directional characteristic of the antenna in the keyless vehicle entry apparatus, as in the seventh embodiment shown in FIG. 21.

Figure 24:
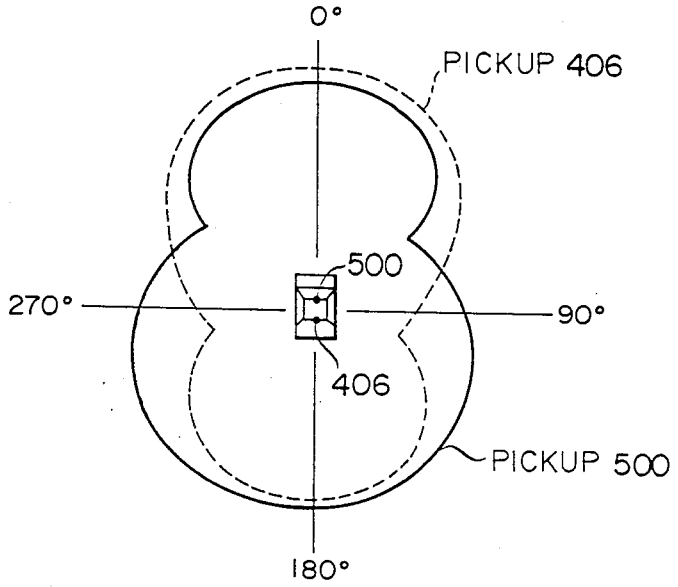
FIG. 24 illustrates the directional patterns of the pickups used for still another embodiment of a keyless vehicle entry apparatus.

FIG. 24 shows the directional patterns of the antenna in still another embodiment of a keyless vehicle entry apparatus according to the present invention.

This embodiment is characterized in that pickups are disposed at the central portion of the front end of the roof and at the central portion of the rear end of the roof, respectively.

As is obvious from FIG. 24, the pickup 406 disposed at the central portion of the rear end of the roof has a good directional characteristic in the forward direction of the vehicle body, while the pickup 500 disposed at the central portion of the front end of the roof has a good directional characteristic in the backward direction of the vehicle body.

Thus, both pickups compensate for each other's lowered sensitivity, thereby constituting an antenna system producing a good directional characteristic.

Figure 25:
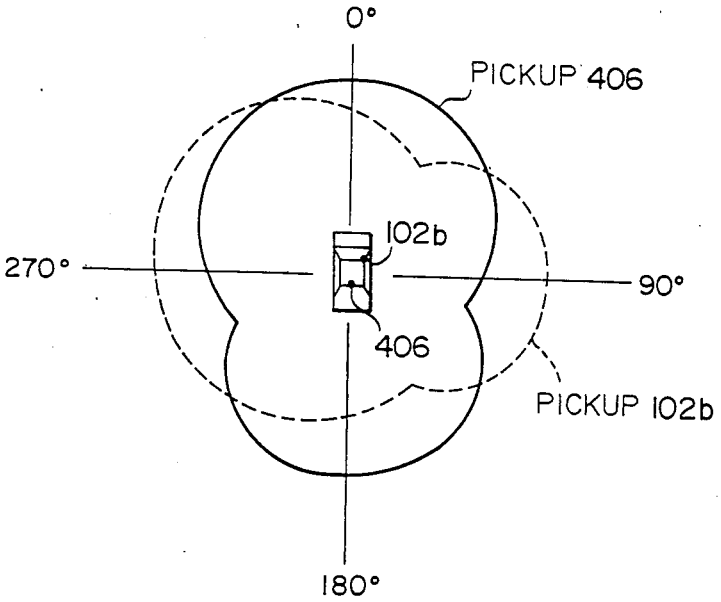
FIG. 25 illustrates the directional patterns of the pickups used for a further embodiment of a keyless vehicle entry apparatus.

FIG. 25 shows the directional patterns of the antenna in a further embodiment of a keyless vehicle entry apparatus according to the present invention.

This embodiment is characterized in that pickups are provided on a front pillar and at the central portion of the rear end of the roof.

As is clear from FIG. 25, the pickup 102b disposed on the front pillar exhibits a good directional characteristic on the right-hand and left-hand sides of the vehicle body, while the pickup 406 disposed at the central portion of the rear end of the roof exhibits a good directional characteristic in the backward and forward directions of the vehicle body.

Thus, both pickups can compensate for each other with respect to the directivity.

Figure 26:
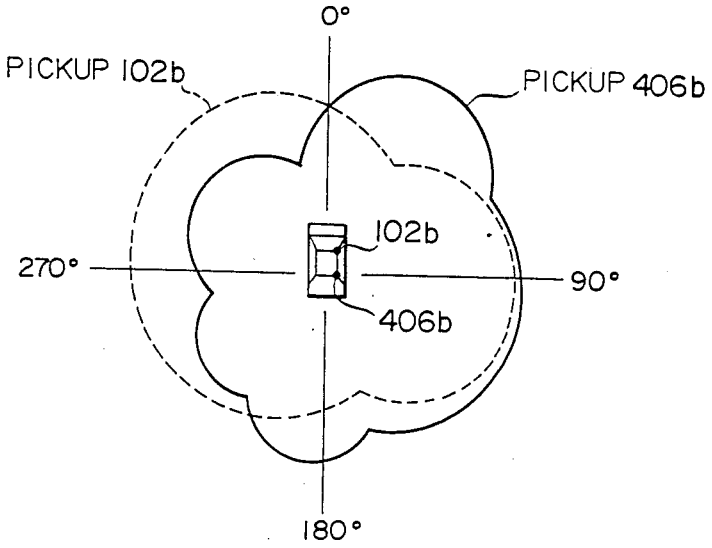
FIG. 26 illustrates the directional patterns of the pickups used for a still further embodiment of a keyless vehicle entry apparatus.

FIG. 26 shows the directional patterns of the antenna in a still further embodiment of a keyless vehicle entry apparatus according to the present invention.

This embodiment is characterized in that pickups are provided on the right-hand front pillar and on the rear right-hand corner the roof, respectively.

As is clear from FIG. 26, the directivities of the pickup 102b disposed on the right-hand front pillar and the pickup 406b disposed on the rear right-hand corner of the roof compensate for each other, thereby constituting an antenna system having a good directional characteristic.

Figure 27:
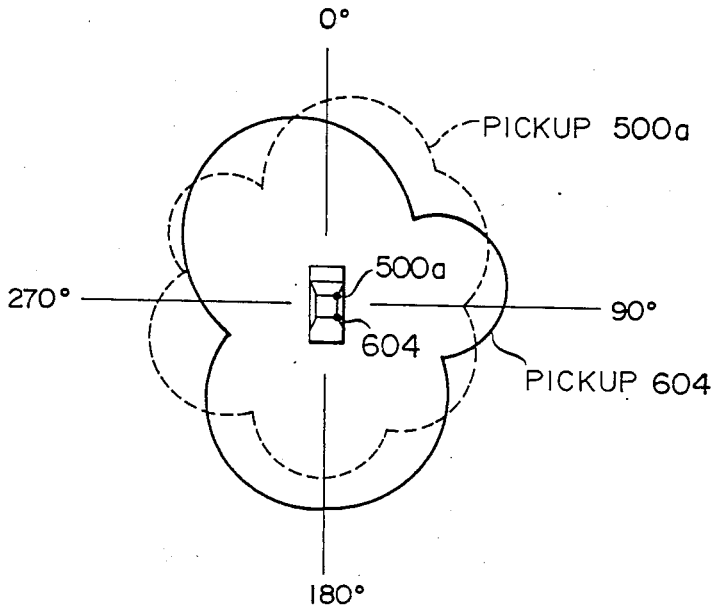
FIG. 27 illustrates the directional patterns of the pickups used for a still further embodiment of a keyless vehicle entry apparatus.
Figure 28:
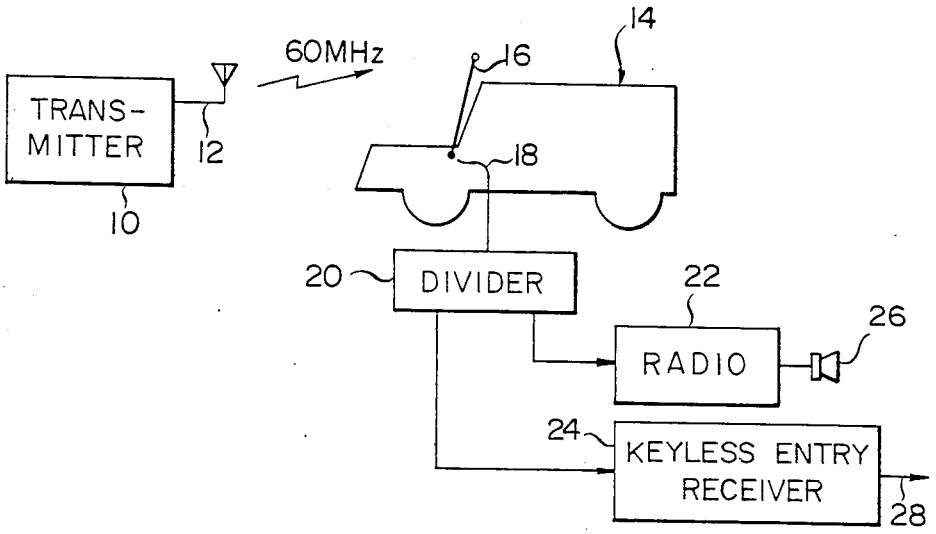
FIG. 28 PRIOR ART
FIG. 28 shows the structure of a conventional keyless vehicle entry apparatus.

FIG. 27 shows the directional patterns of the antenna in a still further embodiment of a keyless vehicle entry apparatus according to the present invention.

This embodiment is characterized in that pickups are provided on the front right-hand corner of the roof and the right-hand trunk hinge of the vehicle body, respectively.

As is obvious from FIG. 27, the pickup 500a provided on the front right-hand corner of the roof and the pickup 604 provided on the right-hand trunk hinge compensate for each other with respect to the directivity, thereby constituting an antenna system of a keyless vehicle entry apparatus having a good directional characteristic.

Although two pickups are provided of the vehicle body in these embodiments, the number of pickups is not limited to two, and provision of three or more pickups is also preferable.

The locations of the pickups are not limited to those in the above-described embodiments and may be any positions where it is possible to detect the high-frequency surface currents induced on the vehicle body by the electric waves from the transmitter.

As described above, according to the present invention, it is possible to provide a keyless vehicle entry apparatus provided with pickups exclusively for use by the apparatus without impairing the aesthetically pleasing external appearance, to prevent the radio broadcast receiving sensitivity from being deteriorated by the division of a receiving signal of the radio broadcasting receiving antenna into two, and, in addition, to reduce the influence of jamming waves by limiting the receiving band of a pickup to a narrow one.

While there has been described what are at present considered to be preferred embodiments of the invention, it will be understood that various modifications may be made thereto, and it is intended that the appended claims cover all such modifications as fall within the true spirit and scope of the invention.

What is climed is:

1. A keyless vehicle entry apparatus for automatically operating a device on a vehicle body by receiving a code signal of high frequency electric waves transmitted from a transmitter, said apparatus comprising:

at least one high frequency pickup means for detecting high frequency surface currents induced on a vehicle body by the high frequency electric waves transmitted by the transmitter and for outputting a detection signal;

mounting means for mounting said at least one high frequency pickup means adjacent to at least one marginal edge portion of the vehicle body;

receiving means including a decoder for receiving and decoding the outputted detection signal from said high frequency pickup means and for outputting a control signal for operating the device on the vehicle body.

2. An apparatus according to claim 1, said at least one high frequency pickup means being longitudinally provided on at least one front pillar.

3. An apparatus according to claim 1, said at least one high frequency pickup means being longitudinally provided on at least one peripheral edge of an engine hood.

4. An apparatus according to claim 1, said at least one high frequency pickup means being longitudinally provided on at least one peripheral edge of a trunk lid.

5. An apparatus according to claim 1, said at least one high frequency pickup means being longitudinally provided on at least one peripheral edge of a roof.

6. The apparatus according to claim 1, the device on the vehicle being a door lock mechanism which is automatically locked and unlocked by said keyless vehicle entry appratus.

7. An apparatus according to claim 1, said at least one high frequency pickup means comprising two high frequency pickup means longitudinally disposed on respective front pillars on both sides of the vehicle body.

8. An apparatus according to claim 1, said at least one high frequency pickup means comprising two high frequency pickup means disposed along a peripheral edge of a roof of said vehicle body.

9. An apparatus according to claim 1, said at least one high frequency pickup means comprising two high frequency pickup means with one disposed on a front pillar and the other disposed at a central portion of a rear end of a roof of the vehicle body.

10. An apparatus according to claim 1, said at least one high frequency pickup means comprising two high frequency pickup means with one disposed in proximity to a side edge of a front roof and the other disposed on a trunk hinge on the same side as said side edge.

* * * * *